US007471913B2

(12) United States Patent
Sawada

(10) Patent No.: US 7,471,913 B2
(45) **Date of Patent: *Dec. 30, 2008**

(54) IMAGE FORMING METHOD AND IMAGE FORMING DEVICE HAVING PROFILE READ FROM RADIO IC CHIP

(75) Inventor: Masaichi Sawada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/707,105

(22) Filed: Feb. 16, 2007

(65) Prior Publication Data

US 2007/0147871 A1 Jun. 28, 2007

Related U.S. Application Data

(63) Continuation of application No. 11/070,285, filed on Mar. 3, 2005, now Pat. No. 7,184,680.

(30) Foreign Application Priority Data

Mar. 9, 2004 (JP) ..... 2004-066075

(51) Int. Cl.
*G03G 15/00* (2006.01)

(52) U.S. Cl. ..... 399/84; 399/83

(58) Field of Classification Search ..... 399/83, 399/84

See application file for complete search history.

(56) References Cited

U.S. PATENT DOCUMENTS

| | | | | |
|---|---|---|---|---|
| 6,798,996 | B2 | 9/2004 | Sawada et al. | |
| 6,827,279 | B2 | 12/2004 | Teraura | |
| 7,184,680 | B2 * | 2/2007 | Sawada | 399/84 |
| 2002/0170973 | A1 * | 11/2002 | Teraura | 235/492 |
| 2005/0089339 | A1 * | 4/2005 | Smith et al. | 399/45 |
| 2005/0141003 | A1 | 6/2005 | Yamamoto et al. | |
| 2005/0201770 | A1 | 9/2005 | Sawada | |
| 2006/0038844 | A1 | 2/2006 | Kiwada et al. | |
| 2006/0082818 | A1 | 4/2006 | Kasamatsu et al. | |

FOREIGN PATENT DOCUMENTS

| | | | |
|---|---|---|---|
| JP | 2002-086862 | | 3/2002 |
| JP | 2002273972 | A | 9/2002 |
| JP | 2003-072156 | | 3/2003 |
| JP | 2004051240 | A * | 2/2004 |

* cited by examiner

*Primary Examiner*—David M Gray
*Assistant Examiner*—Ryan D Walsh
(74) *Attorney, Agent, or Firm*—Morrison & Foerster LLP

(57) ABSTRACT

An image forming method for forming an image on a paper supplied from a paper storage part of an image forming device includes the steps of reading paper information recorded in a radio IC chip attached to a paper provided in the paper storage part, recording information of a reading order of the read paper information in relation to the paper information, by paper information storage means of the image forming device, recording newly read paper information in the paper information storage means, and performing a printing process by using a paper profile based on paper information whose reading order recorded in the paper information storage means is most recent among read paper information, by printing means.

18 Claims, 3 Drawing Sheets

IMAGE FORMING METHOD AND IMAGE FORMING DEVICE HAVING PROFILE READ FROM RADIO IC CHIP

This application is a continuation of Ser. No. 11/070,285 filed Mar. 3, 2005, now U.S. Pat. No. 7,184,680 issued Feb. 27, 2007.

BACKGROUND OF THE INVENTION

1. Field of the Invention

The present invention relates to image forming methods and image forming devices, and more specifically, to an image forming method and image forming device whereby quality dispersion of printing results due to a property of a paper is prevented.

2. Description of the Related Art

A state of an image formed high by an image forming device is changed by a property change based on environmental variations such as temperature and humidity, aging, or the like, of image imaging components, such as electrification equipment, an aligner, a photo conductor drum, or the like used for the image forming device, or various kinds of consumption articles.

In the image forming device, image forming process conditions are controlled according to these property changes and process control for forming an image with tint closer to an ideal condition is automatically and periodically performed, so that color-balance is adjusted. Furthermore, in the image forming device, a gradation correction is performed by using a look-up table corrected by the process control.

However, even if a color in a constant range can be output by the process control, an influence due to the property of the paper is given and therefore quality dispersion of a printing result happens depending on a paper to be printed.

It is normal to use a profile corresponding to a property of an input device or output device for adjustment of color at the input device or output device. See Japanese Patent Application Publication No. 2003-72156 pages 3 through 5. The influence due to the property of the paper is restrained by using the profile corresponding to a property of a paper so that an image with tint closer to an ideal condition may be formed.

Furthermore, a technology whereby a paper used for printing is designated and a printing condition is changed corresponding to the paper is disclosed. See Japanese Patent Application Publication No. 2002-86862 pages 3 through 6. A printing mode is determined based on the property information of the paper by reading the information. Because of this, it is possible to easily make a proper determination about the paper used for printing so that it is possible to print corresponding to the paper.

However, in an actual using state of a printer, different papers are frequently used by the same printer. In this case, it is necessary to print corresponding to properties of respective papers used for printing. However, if the profiles of the respective papers used for printing are prepared in the image forming device, the volume of profile data recorded in the image forming device increases. In addition, it is complex to determine its kind for every kind of paper used for printing.

SUMMARY OF THE INVENTION

Accordingly, it is a general object of the present invention to provide a novel and useful image forming method and image forming device.

Another and more specific object of the present invention is to provide an image forming method and image forming device, whereby quality dispersion of a printing result due to a property of a paper is efficiently prevented while an influence on the amount of a memory of the image forming device is restrained.

The above object of the present invention is achieved by an image forming method for forming an image on a paper supplied from a paper storage part of an image forming device, including the steps of:

reading paper information recorded in a radio IC chip attached to a paper provided in the paper storage part;

recording information of a reading order of the read paper information in relation to the paper information, by paper information storage means of the image forming device;

recording newly read paper information in the paper information storage means; and performing a printing process by using a paper profile based on paper information whose reading order recorded in the paper information storage means is most recent among read paper information, by printing means. (See claim 1).

The above object of the present invention is achieved by an image forming device, the image forming device forming an image on a paper supplied from a paper storage part, including:

a reading part configured to reading paper information recorded in a radio IC chip attached to a paper provided in the paper storage part;

a paper information storage part configured to record information of a reading order of the read paper information in relation to the paper information;

a recording part configured to record newly read paper information in the paper information storage part; and a printing part configured to perform a printing process by using a paper profile based on paper information whose reading order recorded in the paper information storage part is most recent among read paper information. (See claim 6).

The above object of the present invention is achieved by an image forming device, the image forming device forming an image on a paper supplied from a paper storage part, including:

reading means for reading paper information recorded in a radio IC chip attached to a paper provided in the paper storage part;

paper information storage means for recording information of a reading order of the read paper information in relation to the paper information;

recording means for recording newly read paper information in the paper information storage means; and printing means for performing a printing process by using a paper profile based on paper information whose reading order recorded in the paper information storage means is most recent among read paper information. (See claim 11).

According to the above-mentioned inventions, it is possible to perform the printing process by using the paper profile based on the paper information whose reading order is most recent among read paper information read from a radio IC chip attached to the paper stored in the means for storing papers. Accordingly, it is possible to perform the printing process by using the paper property of the paper used for printing and provided at the top among the papers stored in the means for storing papers.

As mentioned in claim 2, in the above-mentioned method, the image forming device may include paper profile storage means for performing the printing process;

the paper profile identified based on the paper information whose reading order recorded in the paper information storage means is most recent among read paper information items, may be recorded in the paper profile storage means; and the paper profile recorded in the paper profile storage means may be updated.

As mentioned in claim 7, the above-mentioned image forming device may include a paper profile storage part used for the printing process;

wherein the printing part may include:

a part configured to record the paper profile identified based on the paper information whose reading order recorded in the paper information storage part is most recent among read paper information item, in the paper profile storage part; and an update part configured to update the paper profile recorded in the paper profile storage part.

As mentioned in claim 12, the above-mentioned image forming device may include paper profile storage means for performing the printing process;

wherein the printing means may include:

means for recording the paper profile identified based on the paper information whose reading order recorded in the paper information storage means is most recent among read paper information items, in the paper profile storage means; and means for updating the paper profile recorded in the paper profile storage part.

According to the above mentioned inventions, in a case where the paper information, for which the reading order recorded in the paper information storage means is most recent among read paper information is not changed, the same paper profile can be used. Hence, it is possible to reduce the workload of the image forming device.

As mentioned in claim 3, in the above-mentioned method, the paper information may include a paper profile of the paper where the radio IC chip is attached, and the printing process may be performed by using the paper profile extracted from the paper information.

As mentioned in claim 8, in the above-mentioned image forming device, the paper information may include a paper profile of the paper where the radio IC chip is attached, and the printing part may include a part configured to perform the printing process by using the paper profile extracted from the paper information.

As mentioned in claim 13, in the above-mentioned image forming device, the paper information may include a paper profile of the paper where the radio IC chip is attached, and the printing means may include means for performing the printing process by using the paper profile extracted from the paper information.

According to the above mentioned inventions, it is possible to perform the printing process by using the paper profile included in the radio IC chip information.

As mentioned in claim 4, in the above-mentioned method, the paper information may include property information of the paper where the radio IC chip is attached, and the paper profile based on the property information of the paper may be generated and the printing process is performed by using the paper profile.

As mentioned in claim 9, in the above-mentioned image forming device, the paper information may include property information of the paper where the radio IC chip is attached, and the printing part may include a part configured to generate the paper profile based on the property information of the paper and perform the printing process by using the paper profile.

As mentioned in claim 14, in the above-mentioned image forming device, the paper information may include property information of the paper where the radio IC chip is attached, and the printing means may include means for generating the paper profile based on the property information of the paper and performing the printing process by using the paper profile.

According to the above mentioned inventions, it is possible to generate the paper profile based on property information of the paper included in the paper information and perform the printing process by using the paper profile.

As mentioned in claim 5, in the above-mentioned method, information about the read order of the paper information may be information about reading time of the paper information.

As mentioned in claim 10, in the above-mentioned image forming device, information about the read order of the paper information may be information about reading time of the paper information.

As mentioned in claim 15, in the above-mentioned image forming device, information about the read order of the paper information may be information about reading time of the paper information.

According to the above mentioned inventions, it is possible to identify a reading order based on the reading time of the paper information.

Other objects, features, and advantages of the present invention will become more apparent from the following detailed description when read in conjunction with the accompanying drawings.

DETAILED DESCRIPTION OF THE PREFERRED EMBODIMENTS

A description of the present invention and details of drawbacks of the related art are now given, with reference to FIG. 1 through FIG. 4. In this embodiment, the present invention is discussed as an image forming method and image forming device whereby a printing process is performed by using a paper profile stored in a radio IC chip attached to a paper.

Figure 1:
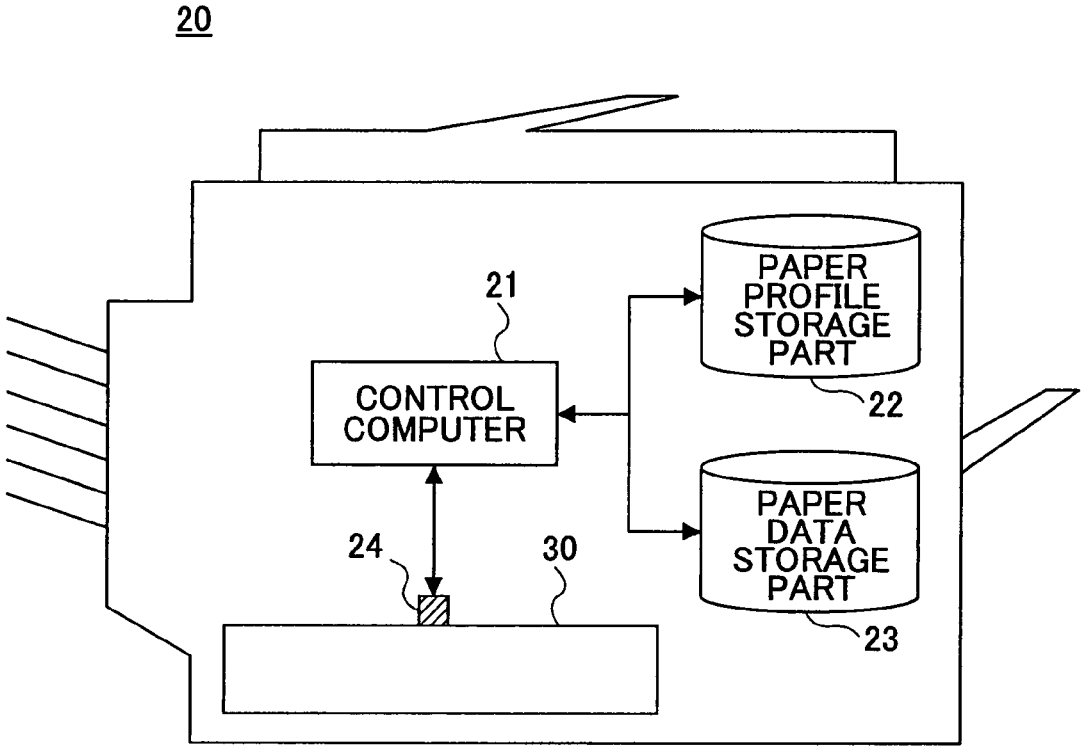
FIG. 1 is a schematic view of an image forming device of an embodiment of the present invention.

In this embodiment, as shown in FIG. 1, an image forming device 20 includes a control computer 21 as means for controlling. The control computer 21 implements various functions for performing image forming. The control computer 21 includes a CPU, a RAM, a ROM, or the like (not shown in FIG. 1) so as to perform processes including a first step, a second step, a third step, or the like that are described below. By implementing a program for this, the control computer 21 functions as first means, second means, third means, or the like.

The control computer 21 is connected to a radio IC chip information reader 24 as means for reading. The radio IC chip information reader 24 transmits and receives an electromagnetic wave to and from a radio IC chip to read radio IC chip information. In this embodiment, the radio IC chip information reader 24 can read plural radio IC chip information items.

The radio IC chip information reader 24 is provided in a paper feeding tray 30 as means for storing paper provided in the image forming device 20. A shield layer is provided in the paper feeding tray 30. Because of this, the radio IC chip information reader 24 reads only the information of the radio IC attached to the paper in the paper feeding tray 30.

In addition, the control computer 21 is connected to a paper profiles storage part 22 as a means for storing paper profile and a paper data storage part 23 as means for storing paper information. A paper profile used for doing a color correction at the time of image forming is recorded in the paper profile storage part 22. In this embodiment, the paper profile is profile data for doing the color correction corresponding to a property of a paper where an image is formed.

Figure 2:
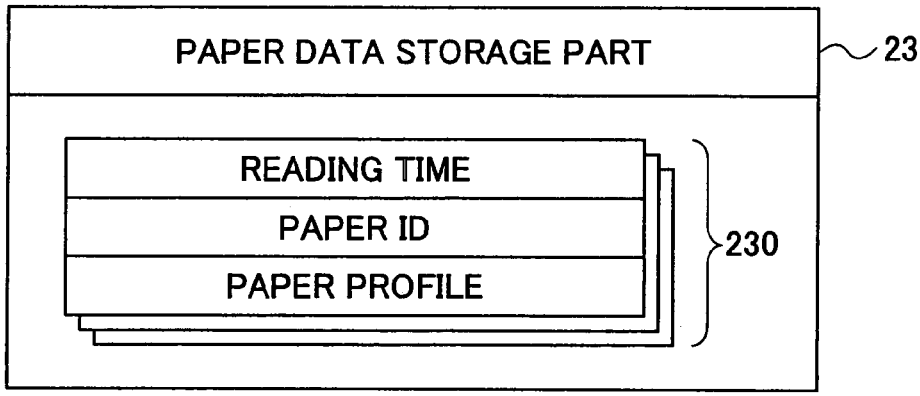
FIG. 2 is a view for an explanation of data stored in a paper data storage part.

As shown in FIG. 2, paper data 230 are recorded in the paper data storage part 23 for every radio IC chip information item being read from the radio IC chips attached to the papers stored in the paper feeding tray 30. The paper data 230 are recorded in a case where the radio IC chip information is read by the radio IC chip information reader 24. The paper data 230 are deleted in a case where the radio IC chip information corresponding to the paper data 230 recorded in the paper profile storage part 22 is not read. The paper data 230 include a reading time, paper identification information, and a paper profile, as shown in FIG. 2.

Data regarding time when the radio IC chip information identified by the paper identification information are recorded in a reading time data area. Data regarding the paper identification information used for designating the paper, included in the radio IC chip information, are recorded in a paper identification information data area. Data regarding the paper profile, included in the radio IC chip information, are recorded in a paper profile data area.

Next, a state of papers set in the paper feeding tray 30 is discussed.

In this embodiment, the radio IC chip is attached to a paper provided at the bottom of a paper package. The radio IC chip may be attached every single paper. Data regarding the paper ID and paper profile are recorded in the radio IC chip. The paper ID is an identifier for designating the radio IC chip. The paper profile is a profile of the paper where the radio IC chip is attached. In a case where the packaged papers have the same properties, it is possible to use the same paper profile.

In a case where the papers are stored in the paper feeding tray 30, new paper may be added before the paper feeding tray 30 becomes empty. In this case, new paper is added in the paper feeding tray 30 so that the paper where the radio IC chip is attached is provided at the bottom.

Figure 3:
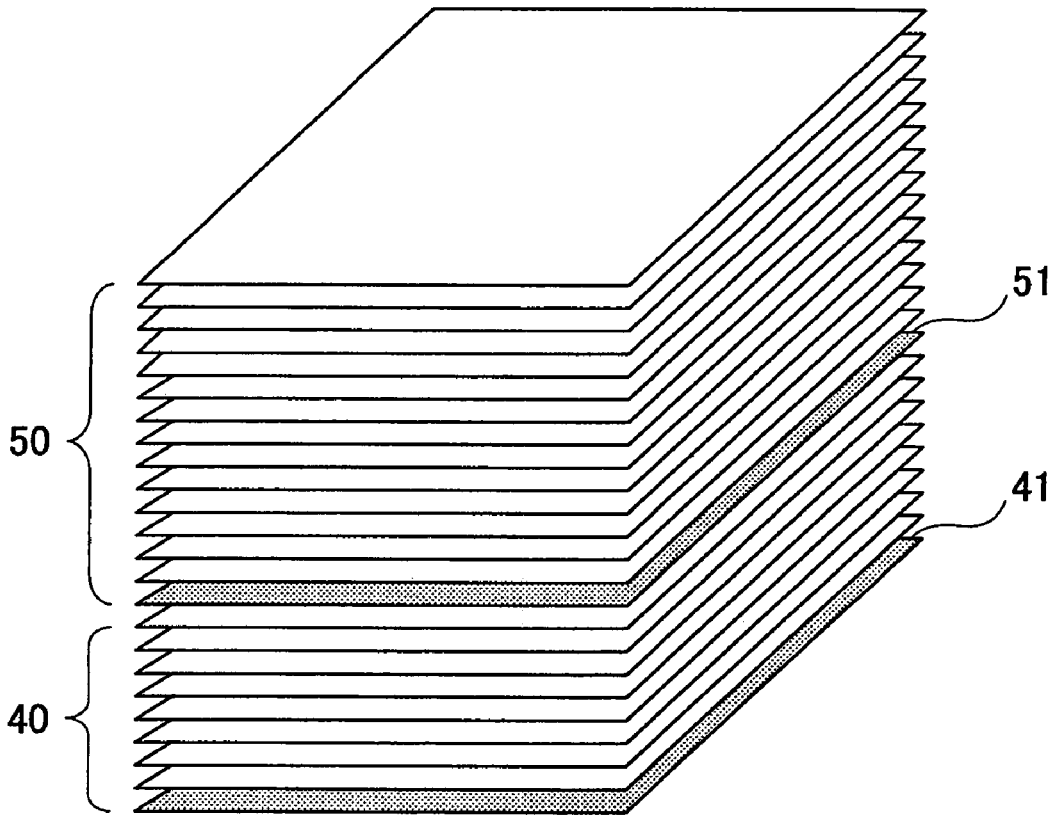
FIG. 3 is a perspective view of papers set in a paper feeding tray.

For example, assuming a situation where a bunch of papers 50 is added in a state where the papers 40 still remain in the paper feeding tray 30, as shown in FIG. 3, a paper 41 where the radio IC chip is attached being provided at the bottom of the bunch of the papers 40. A paper ID and a paper profile of the papers 40 are recorded in the radio IC chip of the paper 41 as the radio IC chip information. A paper 51 where another radio IC chip is attached is provided at the bottom of the bunch of the papers 50. A paper ID and a paper profile of the papers 50 are recorded in the radio IC chip of the paper 51 as the radio IC chip information.

The papers provided in the paper feeding tray 30 are used in turn from the paper provided at the top. Because of this, in a case where the bunch of the papers 50 is provided on the bunch of the papers 40 as shown in FIG. 3, the papers 40 are used after all of the papers 50 are used.

On the other hand, in a case where a radio IC chip is attached to every a single paper, a paper to be used is added to the papers set in the paper feeding tray 30 so that a printing process is performed. In this case, a paper is used by turn from a paper added lastly (most recently).

Furthermore, printing means, communication means, timer means, displaying means, input means, or the like (not shown in drawings) are provided in the image forming device 20. The control computer 21 automatically implements a process control at the time when electric power is turned on or a certain number of the papers are printed. The process control is a control mainly for setting an emission amount of a LED, an electrification electrical potential, a developing bias and amount of toner for refilling to a detection result of an amount of toner adhesion or a surface electric potential of a light-sensitive drum. A refilling control of the toner, setting of respective electric potentials, setting of an emission amount of the LED, a gummer correction, or the like are performed by this control, and feedback is performed so that more proper image forming conditions are obtained. A look-up table which is a standard for performing a proper gradation correction against the image input data regarding respective colors of the toner is updated to be corrected.

Figure 4:
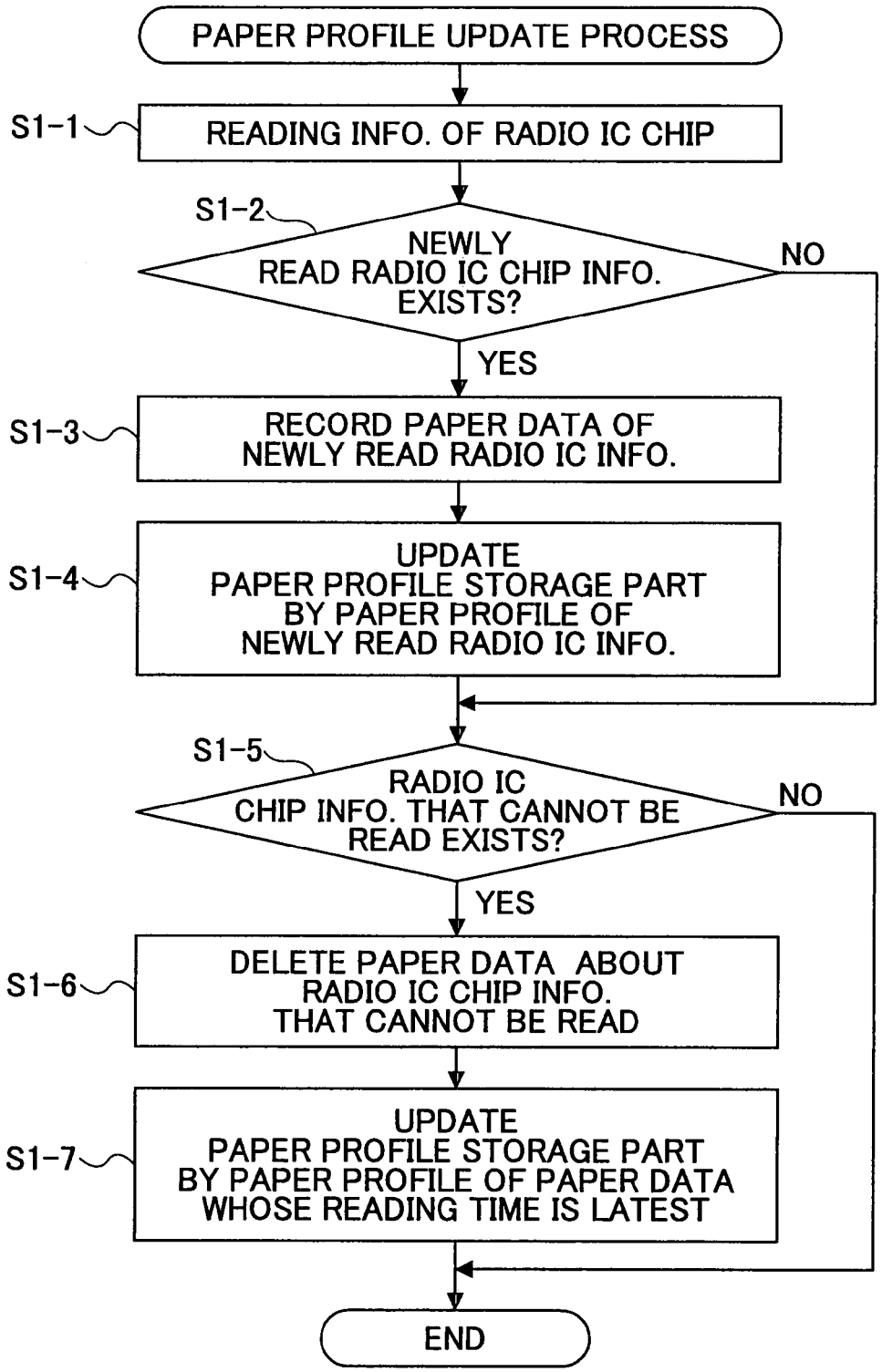
FIG. 4 is a flowchart for an explanation of process steps of an embodiment of the present invention.

Next, process steps in a case where the paper profile used for the color correction by using the above-discussed image forming device 20 are discussed with reference to FIG. 4. As shown in FIG. 4, in the image forming device 20, information of the radio IC chip in the paper feeding tray 30 is periodically read by the radio IC chip reader 24 (step S1-1). In a case where plural radio IC chips exist in the paper feeding tray 30, the radio IC chip information reader 24 can read plural radio IC chip information items. The radio IC chip information reader 24 transmits the read radio IC chip information to the control computer 21.

After receiving the read radio IC chip information, the control computer 21 checks whether newly read radio IC chip information exits (step S1-2). More specifically, the control computer 21 checks whether a paper ID of radio IC chip information not recorded in the paper profile storage part 22 exists. In a case where the paper ID not recorded in the paper profile storage part 22 is included in the read radio IC chip information, the radio IC chip information is newly read radio IC chip information.

If a paper having the radio IC chip is added to the paper feeding tray 30, the radio IC chip information reader 24 newly reads the radio IC chip information. Hence, reading the new radio IC chip information means that the paper having the radio IC chip is added at the top of the paper feeding tray 30.

In a case where the newly read radio IC chip information exists, namely in a case of "YES" in step S1-2, the control computer 21 records paper data 230 of the newly read radio IC chip information (step S1-3). More specifically, the control computer 21 first records the paper ID and paper profile included in the newly read radio IC chip information in the paper data storage part 23. Then, the control computer 21 records the present time obtained by the timer means of the image forming device 20 in the paper data storage part 23.

After that, the control computer 21 updates the paper profile storage part 22 by the paper profile of the newly read radio IC chip information (step S1-4). As a result of this, the paper profile regarding the paper stored at the top of the paper feeding tray 30 is recorded in the paper profile storage part 22.

In a case where the newly read radio IC chip information does not exist, namely in a case of "NO" in step S1-2, the control computer 21 does not implement the above-mentioned processes. Next, the control computer 21 checks whether the radio IC chip information that is not read exists (step S1-5). More specifically, the control computer 21 determines whether a paper ID not included in the read radio IC chip information exists among the paper IDs recorded in the paper profile storage part 22. In a case where the paper ID not included in the read radio IC chip information is recorded in the paper profile storage part 22, the radio IC chip information of the paper ID cannot be read.

In a case where the paper having the radio IC chip is used for printing, the paper is discharged from the image forming device 20. Therefore, since the paper having the radio IC chip does not exist in the paper feeding tray 30, the radio IC chip information reader 24 cannot read the radio IC chip information of the paper. Therefore, in a case where the radio IC chip information that cannot be read exists, the radio IC chip information is information of the radio IC chip attached to the paper printed and discharged from the image forming device 20.

In the case where the radio IC chip information that cannot be read exists, namely in a case of "YES" in step S1-5, the control computer 21 deletes the paper data 230 about the radio IC chip information (step S1-6).

Then, the control computer 21 extracts paper data 230 whose reading time is most recent from the paper storage part 23 so as to update the paper profile storage part 22 by this paper profile (step S1-7). As a result of this, the paper profile of the paper provided at the top of the paper feeding tray 30 is recorded in the paper profile storage part 22. Then, the control computer 21 ends the updating process of this paper profile.

In a case where the radio IC chip information that cannot be read does not exist, namely in a case of "NO" in step S1-5, the control computer 21 end this process. Thus, the paper profile of the paper having the radio IC chip and provided at the top among the papers set in the paper feeding tray 30 is recorded in the paper profile storage part 22.

The control computer 21, in the printing process, implements the gradation correction by using a look-up table recorded by the process control, and implements color correction by using the paper profile extracted from the paper profile storage part 22.

Therefore when printing is performed by using the papers 50, the color correction is made by using the paper profile extracted from the radio IC chip attached to the paper 51. If the paper 51 provided at the bottom of the papers 50 is used, the paper profile storage part 22 is updated by the paper profile of the paper 41. Therefore, in a case where the printing is performed again by using the papers 40, the color correction is made by using the paper profile extracted from the radio IC chip attached to the paper 41.

In the case where a radio IC chip is attached to every single paper and the paper is used for printing and set in the paper feeding tray 30, the radio IC chip information of this paper is read by the radio IC chip information reader 24. At the time of the image forming, the color correction is performed by using the paper profile included in the radio IC chip information. After the printing of this paper is ended, the radio IC chip information attached to this paper cannot be read by the radio IC chip information reader 24. Therefore, the paper profile storage part 22 is updated by the paper profile included in the paper data 230 regarding radio IC chip information read prior to this paper.

According to the above-discussed embodiment, the following effects can be achieved.

First, in this embodiment, the image forming device 20 performs a reading process of the radio IC chip information by the radio IC chip information reader 24. In the case where the radio IC chip information is newly read, the paper data 230 based on the radio IC chip information is stored in the paper data storage part 23. The printing process is performed by using the paper profile extracted from the paper data 230 for which the reading order recorded in the paper storage part 23 is most recent. Therefore, it is possible to perform the printing process by using the paper profile based on the radio IC chip information whose reading order is most recent among the radio IC chip information items read from the radio IC chip attached to the papers stored in the paper feeding tray 30. Accordingly, it is possible to perform the printing process by using the paper property of the paper used for printing and provided at the top among the papers stored in the paper feeding tray 30.

Second, in this embodiment, in the case where the radio IC chip information is newly read, the radio IC chip information is recorded in the paper data storage part 23 and the paper profile storage part 22 is updated by the paper profile included in the radio IC chip information. In the case where the radio IC chip information recorded in the paper profile storage part 23 is not read, the paper data 230 regarding the radio IC chip information is deleted from the paper data storage part 23. In this case, the paper profile storage part 22 is updated by the paper profile of the paper data 230 for which the reading order recorded in the paper data storage part 23 is most recent.

Because of this, when the paper is added, the paper profile storage part 22 is updated by the paper profile of the paper. Furthermore, in a case where papers wherein a paper having the radio IC chip is provided at the bottom are added together, the paper profile storage part 22 is updated by the paper profile included in the radio IC chip information of the paper provided at the bottom. When the paper having the radio IC chip and provided at the bottom is used, the paper profile storage part 22 is updated by the paper profile of the paper added prior to this paper. Therefore, the paper profile included in the radio IC chip information of the paper whose reading order is most recent and provided at the top among the papers having the radio IC chip in the paper feeding tray 30 is always recorded in the paper profile storage part 22. Because of this, in a case where the radio IC chip information whose reading order is most recent among the radio IC chip information sets of the papers in the paper feeding tray 30 is not changed, the same paper profile can be used. Hence, in the case where the papers wherein the paper having the radio IC chip is provided at the bottom are added together, the same paper profile is used for the papers and therefore it is possible to reduce the workload of the image forming device 20.

Third, in this embodiment, the radio IC chip information includes the paper profile of the paper where the radio IC chip is attached. Thus, it is possible to perform the printing process by using the paper profile included in the radio IC chip information.

Fourth, in this embodiment, the reading time of the radio IC chip information is recorded in the paper data storage part 23. Because of this, in a case where the paper having the radio IC chip and provided at the bottom among papers added together is used, paper data 230 of a paper added prior to the paper can be identified based on a reading order. Therefore, the paper profile storage part 22 can be updated by the paper profile included in the radio IC chip information of the paper provided at the top among the papers having the radio IC chip and provided in the paper feeding tray 30.

Fifth, in this embodiment, the paper package is added together in the paper feeding tray 30 and the radio IC chip is attached to the paper provided at the bottom of the papers. Therefore, the paper profile included in the radio IC chip information of the paper provided at the bottom of the paper package is used for the papers added together in the paper feeding tray 30. Hence, it is possible to perform the printing process by using the paper profile proper for the paper to be used without attaching the radio IC chips to all of the papers.

The present invention is not limited to the above-discussed embodiments, but variations and modifications may be made without departing from the scope of the present invention.

For example, in the above-discussed embodiment, the radio IC chip information includes the paper profile and the color correction is performed by using this paper profile. However, the radio IC chip information may include property information of the paper where the radio IC chip is attached and the paper profile may be formed based on this property information. For example, information about smoothness, thickness, glossiness, or the like of the paper may be recorded in the radio IC chip as the property information of the paper. The image forming device may generate the paper profile based on the property information of the paper by using a designated function. Thus, it is possible to perform the printing process corresponding to the paper to be used without recording the paper profile in the radio IC chip.

In the above-discussed embodiment, the reading time of the radio IC chip information is recorded in the paper data storage part 23, and the reading order of the radio IC chip information is identified based on the reading time. The reading order may be identified by recording the reading order in relation to the radio IC chip information.

In this case, the reading order may be identified by recording in an identified storage area in reading order. For example, a storage area corresponding to a setting order of the radio IC chip in the paper feeding tray 30 may be provided, and recording is performed in order in a case where the radio IC chip information is newly read. In a case where the radio IC chip information is not read, the radio IC chip information that is not read based on the storage area may be identified and deleted. In this case, after the radio IC chip information that is not read is deleted, the paper profile may be identified based on the radio IC chip information in the storage area recorded most recently. Thus, the paper profile of the paper to be printed can be identified by the reading order without identifying the reading time.

In this embodiment, a single paper feeding tray 30 is provided in the image forming device 20. Plural paper feeding trays 30 may be provided in the image forming device 20. The image forming device 20 may include a radio IC chip reader 24 configured to read radio IC chip information of papers of respective paper feeding trays 30, and paper profile storage parts 22 and the paper data storage parts corresponding to the respective paper feeding trays 30. In a case where a paper feeding tray 30 configured to feed a paper where an image should be formed is selected, a paper profile is extracted from a paper profile storage part 22 corresponding to the paper feeding tray 30 and color correction is performed by using this paper profile. Thus, in the image forming device 20 having plural paper feeding trays 30, the printing process can be performed by using the paper profiles corresponding to the papers fed from the paper feeding tray 30.

Furthermore, in this embodiment, the papers stored in the paper feeding tray 30 are printed in order from the top, and the paper having the radio IC chip is provided at the bottom of papers in a case where the papers are added together. The paper having the radio IC chip in a case where the papers are added together may not be provided at the bottom of the papers as long as the paper having the radio IC chip is used last. For example, the printing process is performed in order from the bottom, the paper having the radio IC chip being situated at the top of the papers. In this case, since the paper having the radio IC chip is used last among the papers added together, the radio IC chip information is not read and it may be found that all of the papers added together are already used. Therefore, in this case, it is possible to use the same paper profile to the papers added together.

This patent application is based on Japanese Priority Patent Application No. 2004-66075 filed on Mar. 9, 2004, the entire contents of which are hereby incorporated by reference.

What is claimed is:

1. A method of forming an image on a paper, the method comprising the steps of:

attempting to read paper information associated with the paper during a reading operation, recording newly read paper information in a paper information part when paper information is read during the reading operation, updating a paper profile recorded in a paper profile storage part when previously read paper information is not read during the reading operation, and implementing a printing process in accordance with the updated paper profile.

2. The method of claim 1 wherein the paper information comprises information recorded in a radio IC chip associated with the paper.

3. The method of claim 1 wherein a shield layer is provided in a paper feeding tray configured for storing papers.

4. The method of claim 1 wherein the paper profile comprises profile data for color correction corresponding to a property of a paper on which an image is formed.

5. The method of claim 1 wherein data regarding reading time are recorded.

6. The method of claim 1 wherein a paper profile is stored in a radio IC chip.

7. A system for forming an image on a paper comprising:

reading means for reading paper information associated with the paper during a reading operation, recording means for recording newly read paper information in a paper information part when paper information is read during the reading operation, updating means for updating a paper profile recorded in a paper profile storage part when previously read paper information is not read during the reading operation, and printing means for implementing a printing process in accordance with the updated paper profile.

8. The system of claim 7 wherein the paper information comprises information recorded in a radio IC chip associated with the paper.

9. The system of claim 7 wherein a shield layer is provided in a paper feeding tray configured for storing papers.

10. The system of claim 7 wherein the paper profile comprises profile data for color correction corresponding to a property of a paper on which an image is formed.

11. The system of claim 7 wherein data regarding reading time are recorded.

12. The system of claim 7 wherein a paper profile is stored in a radio IC chip.

13. A system for forming an image on a paper comprising:

a paper information reader configured to read paper information associated with the paper during a reading operation, a recorder configured to record newly read paper information in a paper information part when paper information is read during the reading operation, a paper profile storage part configured to update a recorded paper profile when previously read paper information is not read during the reading operation, and a printer configured to implement a printing process in accordance with the updated paper profile.

14. The system of claim 13 wherein the paper information comprises information recorded in a radio IC chip associated with the paper.

15. The system of claim 13 wherein a shield layer is provided in a paper feeding tray configured for storing papers.

16. The system of claim 13 wherein the paper profile comprises profile data for color correction corresponding to a property of a paper on which an image is formed.

17. The system of claim 13 wherein data regarding reading time are recorded.

18. The system of claim 13 wherein a paper profile is stored in a radio IC chip.

* * * * *